United States Patent [19]

Howard

[11] 4,173,961

[45] Nov. 13, 1979

[54] INDUCTIVE SOLID STATE MAGNETO IGNITION SYSTEM

[75] Inventor: William A. Howard, Troy Township, Ashland County, Ohio

[73] Assignee: Delta Systems, Inc., Twinsburg, Ohio

[21] Appl. No.: 770,647

[22] Filed: Feb. 22, 1977

[51] Int. Cl.[2] ..... F02P 1/00; F02M 17/00

[52] U.S. Cl. ..... 123/148 E; 123/179 BG

[58] Field of Search ..... 123/148 E, 148 F, 148 CA, 123/148 CB, 148 CC, 179 BG

[56] References Cited

U.S. PATENT DOCUMENTS

| | | | |
|---|---|---|---|
| Re. 28,392 | 4/1975 | McMillen | 123/148 E |
| 2,943,131 | 6/1960 | Kerr | 123/148 E |
| 3,406,672 | 10/1968 | Phillips et al. | 123/148 E |
| 3,484,677 | 12/1969 | Piteo | 123/148 E |
| 3,504,373 | 3/1970 | Strelow | 123/148 E |
| 3,553,529 | 1/1971 | Strelow | 123/148 CC |
| 3,640,260 | 2/1972 | Mittag et al. | 123/148 E |
| 3,795,826 | 3/1974 | Adey | 123/148 E |
| 3,851,636 | 12/1974 | Just et al. | 123/148 CC |
| 3,938,491 | 2/1976 | Mazza | 123/148 E |
| 4,034,731 | 7/1977 | Sato | 123/148 CC |

*Primary Examiner*—Charles T. Jordan

*Attorney, Agent, or Firm*—Watts, Hoffmann, Fisher & Heinke Co.

[57] ABSTRACT

An inductive, solid-state, magneto ignition system utilizing solid-state switching and operable at low speeds to facilitate starting. Timing is controlled in response to current developed in the primary winding of the magneto coil, which automatically operates a solid-state switch to open the primary winding circuit of the magneto ignition when the current in the primary winding is at a predetermined level. The arrangement couples a high peak voltage and short rise time with a relatively long arc duration across an associated spark plug to increase the over-all performance of a magneto ignition system. In one embodiment, a spark advance is automatically provided as engine speed increases.

19 Claims, 4 Drawing Figures

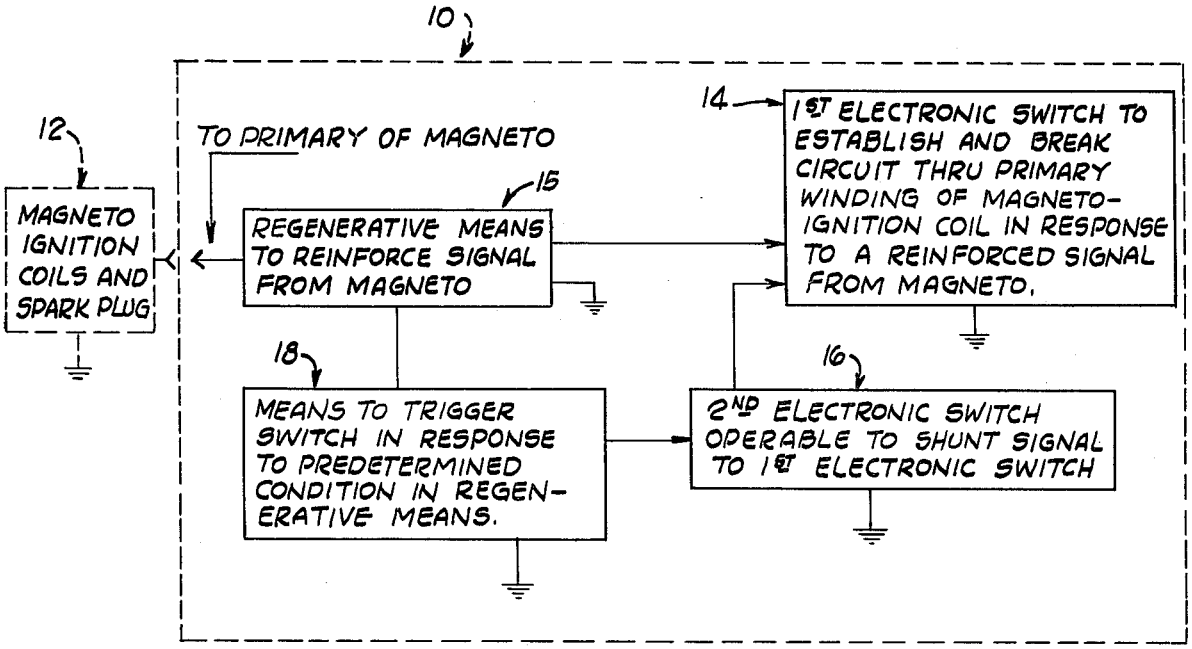
Fig. 1
Fig. 2
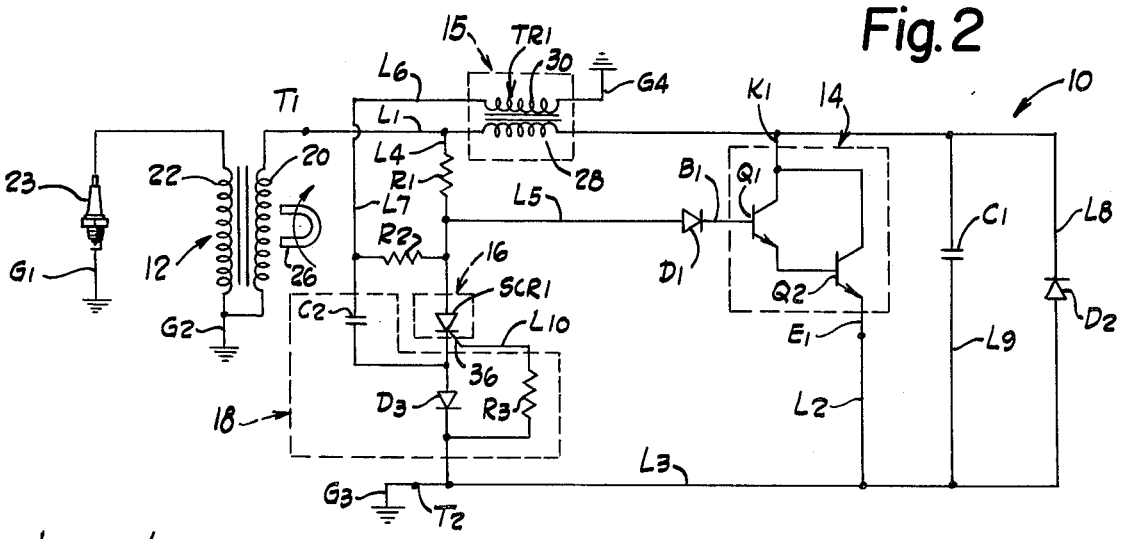
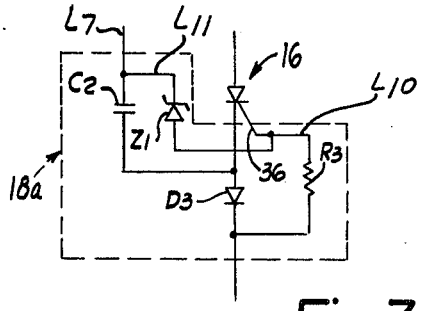
Fig. 3
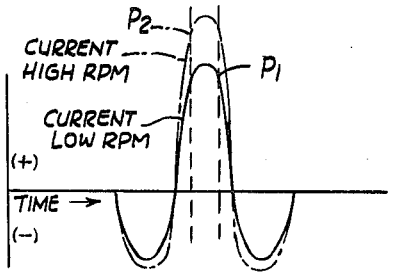
Fig. 4

INDUCTIVE SOLID STATE MAGNETO IGNITION SYSTEM

BACKGROUND OF THE INVENTION

1. Field of the Invention

This invention relates to inductive, solid-state, magneto ignition systems. 2. Prior Art Solid-state ignition systems are typically of either the capacitor discharge ignition (CDI) type or the breakerless inductive type. The CDI type, in which electrical energy is stored by a capacitor and then discharged through an ignition coil, has the advantage of providing a high peak pulse, but the disadvantage of a short duration. As a result, the spark produced does not exist for a sufficient time to assure complete combustion when the fuel mixture is rich and the engine is operated at low speeds. Additionally, during cold starts or after extended periods of non-use, the arc is of insufficient duration to burn off condensate that forms on the spark plug from the fuel mixture in the cylinder and inhibits starting. The inductive type, while providing spark-producing energy over a longer time period, has had a timing problem in triggering the collapse of the spark-producing field in the primary winding of the ignition coil, especially where a low r.p.m. starting mode is desired. For example, where a transistor is used to complete a circuit for the primary winding of an ignition coil and is switched off at a fixed value of the voltage or current in the winding that is desirable for running conditions, low r.p.m. starts become difficult or impossible. This is because the voltage or current level generated in the winding at low r.p.m. fails to reach the value necessary to switch the transistor.

The time at which a spark is produced affects the starting and operating performance of an engine and is typically different for each. Small engines that are equipped with points and condenser control the opening of the points from a cam on the crankshaft. Typically the points will be opened at about 18° of crankshaft rotation prior to the piston reaching the top of its stroke. This provides maximum power during high operating speeds, but makes starting difficult because the engine is harder to crank and often backfires on starting, which may pull the starting rope of a manually cranked engine from the operator's hand or jerk the hand toward the engine. Mechanisms for varying the spark advance at different operating speeds are not usually found on small engines of the type used for lawn mowers and the like.

SUMMARY OF THE INVENTION

The above-mentioned disadvantages of the ignition systems referred to have been overcome by the present invention, in which a sustained spark typical of the inductive type systems is obtained along with the ability to produce a satisfactory spark at low engine r.p.m. In one embodiment, a spark advance is automatically provided as engine speed increases.

Basically, the advantages of the present invention are attained through a regenerative circuit coupled with an electronic switch in the circuit of the primary winding of the magneto ignition coil. The switch is first rendered conductive to establish a field in the primary winding of the ignition coil and then non-conductive to collapse the field and generate the spark-producing voltage and current in the ignition coil secondary winding. The regenerative circuit serves to (a) increase the current applied to a control electrode of the electronic switch to cause the switch to conduct its rated current even though the engine is operating at a low r.p.m. and generating only a small voltage and current through the magneto, and (b) produce a triggering signal to render the electronic switch non-conductive at the appropriate time. Where spark advance is desired, the triggering signal is controlled to vary its timing with a change in the voltage level in the regenerative circuit, which level is indicative of higher engine speed.

More specifically, a transformer is provided in a circuit with the magneto primary coil that does not load the circuit and that, with associated circuitry, performs two functions: (a) it regenerates the low electrical energy created during low r.p.m. operation (e.g., during starting) and applies it to the control electrode of a solid-state switch in the magneto primary circuit to operate the switch, and (b) it responds to the actual current in the magneto primary winding and reverses the mode of the solid-state switch in response to a predetermined condition of the current. The predetermined condition is desirably a reversal of the current rise in the magneto primary winding during starting or low speed operation to utilize the highest voltage available.

This arrangement has the advantages of avoiding the use of distributor points with their inconsistent operation and relatively short life, allowing higher peak voltage and shorter rise time by the elimination of the condenser used with points to prevent arcing, achieving a long arc duration as compared with a CDI type ignition, and functioning well at low engine speeds. Further, the use of the regenerative circuit coupled to the switching circuit by the transformer, creates an isolated control circuit for the switch that allows maximum current flow through the switch, minimizes any loading of the voltage spike in the ignition winding, and permits high resistance to be used in a portion of the switch triggering circuit that is directly coupled to the ignition coil so that subsequent shunting of the triggering circuit will not short circuit the switch. As a result of the relatively low current demands of the present switching circuit, a relatively small magneto winding and coil and small fly wheel magnets can be used.

These and other features and advantages of the invention will become more apparent from the detailed description that follows.

BRIEF DESCRIPTION OF THE DRAWINGS

FIG. 1 is a block diagram of a solid state, breakerless, switching system for an inductive magneto ignition, embodying the present invention;

FIG. 2 is a schematic diagram of a magneto ingition and solid state switching system embodying the present invention.

FIG. 3 is a diagrammatic partial circuit showing a modification of the triggering circuit portion of FIG. 2; and, FIG. 4 is a graph showing current curves in the regenerative circuit portion of FIG. 2, as produced by operation of the associated magneto.

DETAILED DESCRIPTION

A diagrammatic solid state switching circuit embodying the invention is indicated generally by the reference numeral 10 in FIG. 1. The represented structure is connectable to the primary coil of a magneto ignition 12, to provide a breakerless, inductive type, magneto ignition system for an internal combustion engine. The circuit 10 is designed to facilitate engine starting at low r.p.m., and thereby to overcome a principal disadvantage of known inductive type magneto ignition systems.

The circuit 10 has a first electronic switch 14 for making and breaking a circuit for the primary winding of the magneto ignition. The circuit is established through the switch in response to the electrical energy generated from the magneto, but because at low engine r.p.m. the generated electrical energy is insufficient to cause the switch to conduct more than a small current, the energy must be reinforced. This is accomplished with a regenerative feedback of energy to the control electrode of the switch, by a suitable regenerative means indicated generally at 15, causing the switch to conduct a greater current from the magneto. Through this regeneration, the switch is saturated to carry all available current, completing a circuit loop for the magneto primary. Importantly, the regenerative feedback is accomplished without substantially loading the switching circuit during feedback, and when the switching circuit is opened, current to the regenerative means is also interrupted because of its series connection with the switch, so losses are not generated.

The switching circuit 10 has a second normally non-conductive electronic switch 16, operable when changed to a conductive condition to shunt the current to the control electrode of the first electronic switch 14, causing the switch 14 to revert to its non-conductive condition. This opens the circuit to the magneto primary coil, causing the electrical field of the magneto coil to collapse and a high voltage to be generated to fire a spark plug of the engine.

The time at which the second electronic switch 16 becomes conductive is important to the operation of the engine, and the desired timing must be attainable at low engine r.p.m., when the electrical energy generated by the magneto is low. Changing the second electronic switch 16 to its conductive condition is accomplished through the regenerative feedback circuit, which includes, as a component, means 18 (or 18*a* in an alternative embodiment) sensitive to changes in the energy generated in the ignition primary coil and capable of triggering, i.e., changing the condition of, the second electronic switch 16 at a predetermined current condition in the regenerative circuit; specifically, at a desired voltage or current level of, or change in, the voltage or current curves of the electrical energy produced by the magneto in the magneto primary. In a preferred embodiment, a signal is applied to a control electrode of the second switch 16 when the current generated by the magneto peaks and begins to decrease, which produces the highest magneto voltage to fire the spark plug.

With more specific reference now to the circuits 10 and 12, diagrammatically indicated in more detail in FIG. 2, a magneto primary coil 20 and a magneto secondary coil 22 are shown, with the secondary coil 22 connected to a spark plug 23, and the primary coil 20 connected to the circuit 10 through a terminal T1. The return circuit through the magneto coils and spark plug is through ground connections G1, G2 of the plug and magneto coils, respectively, and the ground connection G3 of the circuit 10, through a terminal T2. A magnet 26 of the magneto system, associated with a fly wheel or other moving member of the engine (not shown), provides a moving magnetic field relative to the primary magneto coil 20. With the electrical circuit 10 completed across the magneto coil 20 through the terminal T1, and line L1, the electronic switch 14, a line L2, and a line L3 to the terminal T2 and ground G3, a current is established through the magneto primary coil as the magnetic flux from the magnet 26 moves relative to the coil. Both the voltage and current through the coil 20 and circuit 10 rise to a maximum level or peak, and then fall. By breaking the circuit 10 through the switch 14 when the current in the primary coil 20 of the magneto is at its maximum value, or other desired level or value, the sudden collapse of the electrical field in the primary coil creates a high voltage rise in the secondary magneto coil 22, to create a voltage across the gap of the spark plug 23, sufficient to cause ionization and spark.

In the circuit 10, the regenerative means 15 is a transformer TR1 having a primary coil 28 in the line L1 and in series with the first electronic switch 14, between the terminals T1 and T2. The electronic switch 14 is, in the preferred embodiment, a Darlington transistor comprised of separate transistors Q1, Q2 connected in the conventional manner to provide two power terminals and a control electrode or, more specifically, a collector terminal K1, an emitter terminal E1 and a base terminal B1 of the switch 14. The Darlington transistor normally exhibits a high electrical impedance (i.e., is non-conductive) until a signal is applied to the base B1 through the line L1, a line L4, a resistor R1, a line L5, and a diode D1. The signal is then reinforced once a small current flows through lines L1, L2, L3 and the switch 14. The signal to the base B1 is reinforced by electrical energy from a secondary coil 30 of the transformer TR1 through lines L6, L7, a resistor R2, lines L4, L5, and the diode D1. The coil 30 is grounded at G4.

It is important in the functioning of the circuit 10 that the primary coil 28 of the transformer TR1 has a low impedance and does not reduce the current that must flow through the line L1 (especially at low engine r.p.m.) to provide proper ignition performance in a typical circuit for use with a magneto of, e.g., a lawn mower-type engine. Also, by having the primary coil 28 in series with the switch 14, current cannot flow through the coil when the switch is rendered non-conductive and coil losses are eliminated when the desired voltage spike occurs to fire the spark plug.

As current through the switch 14 increases due to continued movement of the magnet 26 past the coil 20, the regenerative action through the transformer TR1, continues. While the transformer TR1 steps up the voltage, additional amperage is also regenerated and applied to the base B1 sufficient to affect conductivity through the transistors Q1, Q2, which become saturated when current through the primary coil 28 of the transformer TR1 is approximately 1 ampere, in the preferred embodiment. The switch 14 then becomes fully conductive and carries the full current (typically 5 amperes) generated by the ignition coil primary 20.

The switching circuit is protected from excessive reverse voltage by a diode D2 in a line L8, across lines L1 and L3. A capacitor C1 in a line L9 across the switch 14 prevents any voltage spike that may occur from exceeding the electrical capacity of the switch.

The second electronic switch 16 is, in the preferred embodiment of the invention, a silicon controlled rectifier SCR1 having two power terminals connected across lines L5 and L3 by the line L4, to shunt the base B1 of the Darlington switch 14 when the SCR1 is rendered conductive. Normally, SCR1 is in a non-conductive state, but is switched to a conductive state when a signal is applied through a control electrode or gate 36. Once conductive, SCR1 tends to remain so as long as current is being carried. The control electrode 36 is connected to ground G3 through line L10, a resistor R3, and line L4. When SCR1 is switched to its conductive state, it shunts the base B1 of the switch 14, which rapidly changes to a non-conductive state, thus "opening" the circuit of the ignition coil primary 20, causing the electrical field in the primary to collapse and generate a voltage spike in the secondary coil 22.

A voltage signal is applied to the control electrode 36 of SCR1 through line L6, the secondary coil 30 of the transformer TR1, to the ground connection G4, thence through ground G3, terminal T2, line L4, line L10, and resistor R3. The voltage signal is produced, in the embodiment of FIG. 2, from the charge of a capacitor C2, which comprises the means to trigger the switch 16. The capacitor is charged by energy from the secondary 30 of the transformer TR1. The capacitor C2 charges as current flows through the switch 14 while the voltage and current in the magneto primary 20 are increasing. Once the current in the primary 20 peaks and starts to decrease, by virtue of the movement of the magnetic field from the magnet 26 passing by the coil 20, the capacitor C2 begins to discharge back through the secondary coil 30 to ground G4 and G3, and then through the terminal T2 to the control electrode 36 (the circuit to the cathode of SCR1 being blocked by a diode D3), causing SCR1 to become conductive. Diode D1 in line L5 is provided to establish a voltage drop of approximately 1 volt so that switch 14 turns off when switch 16 conducts. It will be apparent that the timing of the cutoff of current through the Darlington switch 14 is controlled by the voltage in the regenerative circuit of the secondary coil 30 of the transformer TR1 by the use of the capacitor C2.

Upon interruption of the current flowing through the primary coil 20 of the magneto, a voltage spike, typically 300 volts in one preferred embodiment, is produced, which induces a voltage pulse of approximately 20,000 volts in the ignition secondary coil 22, to fire the spark plug 23.

A modified triggering means **18*a* for controlling the second electronic switch 16 (SCR1) is shown in FIG. 3. The circuit 18*a* is identical to the circuit 18 except for a Zener diode Z1 connected by a line L11 between lines L7 and L10 (i.e., between the secondary coil 30 of the transformer TR1 and the control electrode 36. As a result, when the current in the regenerative circuit rises to a predetermined value as a result of the rise in the magneto primary current caused by increasing engine speed, the Zener diode will conduct at a desired value, triggering SCR1 to shunt the base of the electronic switch 14**. By selecting a Zener diode that conducts at a current magnitude less than the maximum current generated by the magneto, the effect will be to advance the point on the voltage curve at which the SCR1 conducts and fires the spark plug. This, of course, results in the engine firing at an advanced point in its cycle relative to the point at which the capacitor C2 would have triggered SCR1. Thus, at starting and low engine r.p.m., spark is achieved at a point on the voltage curve of the magneto when maximum energy is available and where the piston is at or slightly beyond top dead center, facilitating ease of starting. As high engine r.p.m., spark occurs prior to the piston reaching top dead center, providing maximum torque.

FIG. 4 diagrammatically illustrates curves of currents produced by the magneto primary coil at low and high engine r.p.m., illustrating at point P1 the location at which the capacitor C2 triggers SCR1 and at point P2 the location where the Zener diode Z1 triggers SCR1.

Suitable values for the components referred to above for use with a commercial magneto type engine, such as the type used on lawn mowers and the like, that typically range from 1 through 20 horsepower, are indicated in the table below:

TABLE

| Component | Value |
|---|---|
| Resistor R1 | 1K ohms |
| Resistor R2 | 680 ohms |
| Resistor R3 | 500 ohms |
| Capacitor C1 | 0.1 microfarad |
| Capacitor C2 | 0.02 microfarad |
| Transformer TR1 | primary coil - 20 turns No. 22 wire; secondary coil - 100 turns No. 36 wire |
| Zener Diode Z1 | 5.6 volts |

From the foregoing, it should be appreciated that the relatively high resistance of R1 prevents the triggering circuit 18 from loading the voltage spike produced in the primary magneto winding. Without the isolation and power generation provided by the regenerative means 15, resistor R1 would have to be much lower in value to permit switching of switch 14 through base B1, or significantly more power would have to be available from the magneto. A lower value R1 loads the voltage spike, taking energy needed for spark, and larger magneto coils and fly wheel magnet and generating greater current, make hand cranking difficult.

Within the scope of the invention, certain circuit modifications are contemplated. For example, a switch component other than a Darlington transistor can be used for the first electronic switch 14, such as a single transistor with adequate gain, or other gate turn off device as long as it has the capability of being readily switched to a non-conductive condition. Also, with certain magneto designs, the polarities indicated in connection with the present circuit may be reversed. In addition to the above, it will be understood that other modifications or alterations may be made without departing from the spirit or scope of the invention set forth in the appended claims.

What is claimed is:

1. In an inductive solid-state magneto ignition system having a magneto ignition coil with primary and secondary windings:

first circuit means including a first electronic control means for connection across the primary winding of the magneto ignition coil, said control means having power terminals and a control electrode and being changeable between conditions exhibiting low and high electrical impedances to establish and break a low resistance circuit across the primary magneto winding;

second circuit means for energization by the primary magneto winding and operatively connected to said control electrode for applying electrical energy from the primary magneto winding to the control electrode, and third circuit means inductively coupled for power to said first circuit means, to increase and decrease the level of electrical energy applied to said control electrode, in response to the electrical energy generated in the primary winding of the magneto coil, the electrical operation of all said circuit means being dependent solely upon magneto-generated energy.

2. The circuit as set forth in claim 1 wherein said second circuit means includes means to substantially limit current flow from the primary magneto winding through the second circuit means.

3. The circuit as set forth in claim 1 wherein the third circuit means includes a second electronic control means having power terminals and a control electrode and being changeable between conditions exhibiting low and high electrical impedances, for shunting current otherwise conducted to the control electrode of the first electronic control means in response to a predetermined electrical energy level in the primary magneto winding.

4. The circuit as set forth in claim 3 wherein said first electronic control means is of the transistor-type capable of being rapidly changed between low and high electrical impedances and said second electronic control means is of the type that once changed to a condition of low electrical impedance tends to maintain such condition as long as current is conducted.

5. The circuit as set forth in claim 3 wherein the second electronic control means is changeable in response to a decrease in the current level in the primary magneto winding after a rise in the level.

6. The circuit as set forth in claim 1 wherein the third circuit means includes a secondary winding of a transformer, a primary winding of which is a part of said first circuit means, for increasing a voltage of the first circuit means in the transformer primary winding and applying the increased voltage to said control electrode to change the condition of the control means to a condition exhibiting a low electrical impedance.

7. In an inductive solid-state magneto ignition system having a magneto ignition coil with primary and secondary windings:

a first circuit across the primary winding of the magneto ignition coil, including an electronic switch in series with the winding to establish and break the circuit, said switch having a control electrode for changing the condition of the switch between conducting and non-conducting modes, a second circuit to conduct current from said first circuit to said control electrode, said second circuit including first means to establish a significant voltage drop between the first circuit and the control electrode, means, including a second electronic switch coupled to said control electrode, operable to reduce conduction of current to said control electrode, and a third circuit inductively coupled to the first circuit and conductively connected to said control electrode to apply electrical energy to said control electrode, and conductively connected to the second electronic switch to change the condition of the second electronic switch to that in which it reduces current being conducted to said control electrode, in response to a predetermined change in the absolute level of electrical energy in the first circuit.

8. The circuit as set forth in claim 7 wherein said third circuit includes energy storage means responsive to the energy level in the first circuit to operate said second electronic switch.

9. A circuit for connection across a primary winding of a magneto ignition coil, comprising:

an electronic switch operable to selectively open and close said circuit, means to apply electrical energy from the primary winding to said electronic switch to cause the switch to partially conduct, regenerative means to derive electrical energy from said circuit and to apply the energy at an increased voltage to said switch to lower its electrical impendance, control means operable to inhibit conduction to the electronic switch of electrical energy that causes the switch to lower its electrical impedance, and means coupled to said regenerative means to operate said control means in response to a change in the electrical energy from said primary winding.

10. The circuit as set forth in claim 9 wherein said regenerative means includes a transformer a primary coil of which is connected in series with said primary winding and said electronic switch.

11. The circuit as set forth in claim 9 wherein said control means is an electronic switch having a control electrode and said means to operate said control means is a capacitor that applies an electrical signal to the control electrode in response to a reversal of absolute current rise in said primary winding.

12. The circuit as set forth in claim 9 wherein said control means is an electronic switch having a control electrode and said means to operate said control means is a Zener diode that allows said derived electrical energy to be applied to said control electrode when the derived electrical energy reaches a predetermined voltage level and thereby operates said electronic switch.

13. The circuit as set forth in claim 9 wherein said control means is an electronic switch having a control electrode and said means to operate said control means includes a capacitor that applies an electrical signal to the control electrode in response to a reversal of the absolute current rise in said primary winding and a Zener diode that allows said derived electrical energy to be applied to said control electrode when the derived electrical energy reaches a predetermined voltage level and thereby operates said electronic switch.

14. The circuit as set forth in claim 9 wherein said control means includes a Zener diode that allows said derived electrical energy to be applied to said control electrode when the derived electrical energy reaches a predetermined voltage level and thereby operates said electronic switch, and a capacitor that applies an electrical signal to the control electrode in response to a reversal of absolute current rise in said primary winding below said predetermined voltage level.

15. For connection across a primary winding of a magneto ignition coil; a first circuit having a switch with a control lead that changes the condition of the switch in response to electrical energy, and a second circuit coupled to the first circuit and including an inductively coupled power source responsive to electrical energy in the first circuit for supplying current to the control lead of said switch.

16. The circuits as set forth in claim 15 wherein said second circuit includes means sensitive to the energy in the first circuit for controlling the supply of energy to the control lead of said switch, whereby the condition of said switch is changed at a predetermined condition of the current from the primary winding of the magneto ignition coil.

17. The circuits as set forth in claim 16 wherein the supply of energy to the control lead of said switch is controlled by a second switch in said second circuit, electrically connected to shunt current from said control lead when said predetermined condition is reached.

18. The circuits as set forth in claim 17 wherein said second circuit includes a capacitor sensitive to said predetermined condition and electrically connected to operate said second switch.

19. The circuits as set forth in claim 15 wherein said inductively coupled power source supplies current to the control lead at a voltage higher than a substantially concurrent voltage of the electrical energy in the first circuit.

* * * * *